US007924535B2

(12) United States Patent
Kao

(10) Patent No.: US 7,924,535 B2
(45) Date of Patent: Apr. 12, 2011

(54) ELECTRONIC ARC EXTINGUISHING DEVICE

(75) Inventor: Sui-Chan Kao, Taipei (TW)

(73) Assignee: Goodwell Electric Corp., Taipei (TW)

( * ) Notice: Subject to any disclaimer, the term of this patent is extended or adjusted under 35 U.S.C. 154(b) by 146 days.

(21) Appl. No.: 12/497,609

(22) Filed: Jul. 3, 2009

(65) Prior Publication Data

US 2010/0007997 A1 Jan. 14, 2010

(30) Foreign Application Priority Data

Jul. 11, 2008 (TW) ..... 97212354 U

(51) Int. Cl.
*H02H 3/00* (2006.01)

(52) U.S. Cl. ..... 361/2; 361/8

(58) Field of Classification Search ..... 361/2, 8, 361/13

See application file for complete search history.

(56) References Cited

U.S. PATENT DOCUMENTS 3,982,137 A * 9/1976 Penrod ..... 361/8
6,707,171 B1 * 3/2004 Huenner et al. ..... 307/113

* cited by examiner

*Primary Examiner* — Danny Nguyen
(74) *Attorney, Agent, or Firm* — WPAT, P.C.; Justin King

(57) ABSTRACT

An electronic switch structure capable of extinguishing arcs is provided. A device capable of extinguishing arcs generated when an electric switch is turned on or off is in a following structure. Two silicon controlled rectifiers are connected in inverse parallel. Trigger ports of the silicon controlled rectifiers are connected to triggering current limiting circuits each formed by a diode and a resistor connected in series, respectively. Positive poles and negative poles of the silicon controlled rectifiers are connected to a voltage dependent resistor and a resistance-capacitance absorption circuit for over voltage protection in parallel. A triggering end of the device is connected to a contact bridge of the switch. Two ends connected in inverse parallel of the silicon controlled rectifiers are connected to two ends of fixed contacts of the switch respectively. Thus, an electronic arc extinguishing device having a simple structure, a small volume, and high reliability is formed.

7 Claims, 1 Drawing Sheet

ELECTRONIC ARC EXTINGUISHING DEVICE

BACKGROUND OF THE INVENTION

1. Field of Invention

The present invention relates to an electronic switch structure capable of extinguishing arcs, and more particularly to an electronic arc extinguishing device having a simple structure, a small volume, and high reliability.

2. Related Art

In the era of electricity nowadays, various electronic switches are widely applied in the industrial control field to control load. To enhance the capability of arc interruption of electronic switches, a bridge structure is used in most electronic switches. However, as electrical contacts of a common bridge structure are exposed to air, the arcs generated during the process when the switch is turned on or off are so large that the contacts are easily burnt out. In the work conditions of a rated current, an electrical life of an electronic switch in the bridge structure is usually only several tens of thousands of times, which is much shorter than the life of several hundreds of thousands of times of a conventional mechanical switch. The conventional electronic switch must be frequently maintained and replaced, and therefore it is an undesirable implementation structure in terms of labor, time, and cost.

The objective of the present invention is to eliminate the deficiencies and disadvantages of the conventional electronic switch, so as to provide an electronic switch structure having a simple structure, a small volume, and high reliability that is capable of extinguishing arcs.

SUMMARY OF THE INVENTION

In view of disadvantages in the prior art, a main objective of the present invention is to prevent deficiencies and disadvantages in the prior art, so as to provide an electronic arc extinguishing device having a simple structure, a small volume, and high reliability.

To achieve the objective, the present invention is an electronic switch structure capable of extinguishing arcs. The electronic switch structure includes two fixed contacts, a contact bridge, two rectifying elements, two current limiting elements, and two silicon controlled rectifiers.

The contact bridge is used to form an electrical connection with the two fixed contacts.

The two rectifying elements are used to generate a voltage drop to realize a rectification effect.

The two current limiting elements are used to limit a current to a unidirectional flow.

The two silicon controlled rectifiers are connected in inverse parallel. Two ends of the two silicon controlled rectifiers are connected to the two fixed contacts. Trigger ports of the two silicon controlled rectifiers are connected to a rectifying element and a current limiting element respectively. Another end of the rectifying element and the current limiting element is connected to the contact bridge.

Preferably, the electronic switch structure capable of extinguishing arcs further includes a voltage stabilizer, and the voltage stabilizer and the two silicon controlled rectifiers are connected in parallel.

Preferably, the voltage stabilizer is formed by a resistor and a capacitor connected in series.

Preferably, the electronic switch structure capable of extinguishing arcs further includes a voltage protector, and the voltage protector and the two silicon controlled rectifiers are connected in parallel.

Preferably, the voltage protector is formed of a voltage dependent resistor.

Preferably, the two rectifying elements are formed of resistors.

Preferably, the two current limiting elements are formed of diodes.

The present invention is illustrated with reference to specific embodiments in the following. Thus, persons skilled in the art may readily understand advantages and effects of the present invention from the content disclosed in the specification and drawings. Based on the spirit of the present invention, details in the specification may also be implemented and varied according to different purposes and applications.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1:
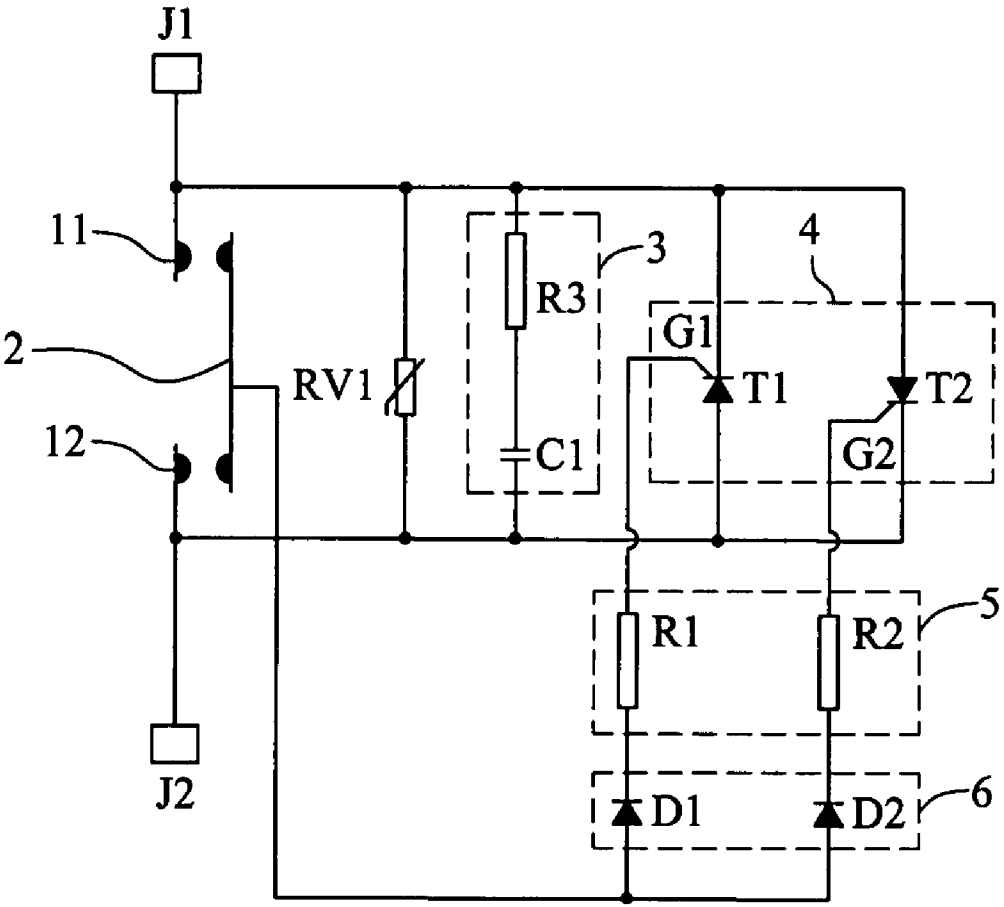
FIG. 1 is a schematic view of an electronic switch structure capable of extinguishing arcs of the present invention.

To make the features, objectives, and functions of the present invention more comprehensible, detailed structures and design ideas of the present invention are illustrated in the following, such that the examiner may understand the characteristics of the present invention. The detailed illustration is as follows.

The detailed structures and the connection of the present invention are illustrated with reference to the accompanying drawings for ease of understanding.

In the present invention, an electronic switch capable of extinguishing arcs is in the following structure. Two silicon controlled rectifiers are connected in inverse parallel. Trigger ports of the silicon controlled rectifiers are connected to triggering current limiting circuits each formed by a diode and a resistor connected in series. Positive ends and negative ends of the silicon controlled rectifiers are connected in parallel to a voltage dependent resistor and a resistance-capacitance absorption circuit for over voltage protection. During the arc extinguishing, the positive ends and the negative ends of the silicon controlled rectifiers connected in parallel are connected to two ends of fixed contact of the electronic switch respectively. Input ends of the triggering current limiting circuits are connected to a contact bridge of the electronic switch. At the moment when an AC contactor is switched off or switched on, for example, when a through current is not zero, a relatively high potential difference is generated between the contact bridge and two fixed contacts. The voltage then triggers the silicon controlled rectifiers, such that the silicon controlled rectifiers connected in parallel to the two fixed contacts ends are turned on, and the current flows through a by-pass of the silicon controlled rectifiers, so as to achieve an arc extinguishing effect. In the operation to turn on the electronic switch, after the contacts are completely closed, a voltage drop between the two fixed contacts will be less than a turn-on voltage of the silicon controlled rectifiers, so the silicon controlled rectifiers will be turned off automatically. In the operation to turn off the switch, after the operation is completed, no through current exists on the contact bridge, so the silicon controlled rectifiers are automatically turned off when the current through the silicon controlled rectifiers exceeds zero in a state when no trigger signal exists. In theory, the longest working time for the module to extinguish arcs once actually is half wavelength, and only one silicon controlled rectifier is in operation. This may greatly increase the capacity utilization of the silicon controlled rectifiers, and allows a relatively great current to pass through silicon controlled rectifiers of a small capacity.

As for the structure of a practical electronic switch, FIG. 1 is a schematic view of the electronic switch structure capable of extinguishing arcs of the present invention. An arc extinguishing element 4 includes a first silicon controlled rectifier T1 and a second silicon controlled rectifier T2. The first silicon controlled rectifier T1 and the second silicon controlled rectifier T2 are connected in inverse parallel, and a voltage protector RV1 is connected in parallel thereto. The voltage protector RV1 is used to absorb over voltage to protect the arc extinguishing circuit element from breakdown. The voltage protector RV1 is formed by a voltage dependent resistor. A voltage stabilizer 3 includes a first capacitor C1 and a third resistor R3 connected in series. The voltage stabilizer 3 and the two silicon controlled rectifiers (T1, T2) are connected in parallel, so as to reduce the impact on the silicon controlled rectifiers caused by the voltage rise rate of a power source, and prevent the two silicon controlled rectifiers (T1, T2) from being turned on by mistake.

Trigger ports (G1, G2) corresponding to the two silicon controlled rectifiers (T1, T2) are connected with two current limiting elements 6 for limiting a current to a unidirectional flow. The two current limiting elements 6 are formed of a first diode D1 and a second diode D2. Also, a rectifying element 5 includes a first resistor R1 and a second resistor R2 for generating a voltage drop to achieve the rectification effect. The arc extinguishing device 4 has three lead terminals. The trigger ports (G1, G2) are connected to a contact bridge 2, and another two ends are connected to a first fixed contact and a second fixed contact (11, 12). During the process for turning off/on the switch, when the first fixed contact (11) is at a positive potential to the second fixed contact (12), and the first fixed contact (11) has a potential difference more than several volts to the contact bridge 2, the second diode D2 is turned on. The current generated by the voltage is limited by the second resistor R2 to trigger and turn on the second silicon controlled rectifier T2. When a through current is zero or when the voltage at two ends of the second silicon controlled rectifier T2 is less than its turn-on voltage, the second silicon controlled rectifier T2 is turned off automatically. During the process for turning off/on the switch, when the second fixed contact (12) is at a positive potential to the first fixed contact (11), and the second fixed contact (12) has a potential difference more than several volts to a contact bridge 13, the first diode D1 is turned on. The current generated by the voltage is limited by the first resistor R1 to trigger and turn on the first silicon controlled rectifier T1. When the through current is zero or the at the two ends of the first silicon controlled rectifier T1 are less than its turn-on voltage, the first silicon controlled rectifier T1 is turned off automatically. Therefore, the arc extinguishing principles of the arc extinguishing device are to turn on the arc extinguishing element 4 connected to the first fixed contact and the second fixed contact (11, 12) in parallel at the moment that the switch is turned off or turned on. The current flows through a by-pass of the arc extinguishing element 4, and thereby achieves the arc extinguishing effect.

The electronic arc extinguishing device has the following advantages.

1. Timeliness, high capacity utilization of the silicon controlled rectifiers, and no additional control power source required;

2. Fewer elements, simple circuits, low cost, small volume and little temperature rise, and high reliability;

3. The electronic arc extinguishing device enables an electrical life of the switch to be extended equal to its mechanical life. That is, the life is increased by more than ten times. Therefore, the time, energy, and money consumed in maintenance of the equipment circuit are saved, and an electrical failure rate of the equipment is greatly reduced, resulting in clear economic benefits.

In conclusion, the present invention has an inventive step in implementation in terms of the objectives and efficacies, has high industrial applicability, and is new in the market. That is, the present invention meets the requirements of patentability for a utility model. Therefore, the applicant files an application according to the Patent Law. The above description is only a preferred embodiment of the present invention, and is not intended to limit the scope of the present invention. Equivalent variations and modifications made according to the claims of the present invention should fall within the scope of the present invention.

What is claimed is:

1. An electronic switch structure capable of extinguishing arcs, comprising:

two fixed contacts;

a contact bridge, for forming an electrical connection with the two fixed contacts;

two rectifying elements, for generating a voltage drop to realize a rectification effect;

two current limiting elements, for limiting a current to a unidirectional flow; and two silicon controlled rectifiers, connected in inverse parallel, wherein two ends of the two silicon controlled rectifiers are connected to the two fixed contacts, and trigger ports of the two silicon controlled rectifiers are serially connected to a rectifying element and a current limiting element respectively, and an other end of the rectifying element and an other end of the current limiting element are connected to the contact bridge.

2. The electronic switch structure capable of extinguishing arcs according to claim 1, further comprising a voltage stabilizer, wherein the voltage stabilizer and the two silicon controlled rectifiers are connected in parallel.

3. The electronic switch structure capable of extinguishing arcs according to claim 2, wherein the voltage stabilizer is formed by a resistor and a capacitor connected in series.

4. The electronic switch structure capable of extinguishing arcs according to claim 1, further comprising a voltage protector, wherein the voltage protector and the two silicon controlled rectifiers are connected in parallel.

5. The electronic switch structure capable of extinguishing arcs according to claim 4, wherein the voltage protector is formed by a voltage dependent resistor.

6. The electronic switch structure capable of extinguishing arcs according to claim 1, wherein the two rectifying elements are formed by resistors.

7. The electronic switch structure capable of extinguishing arcs according to claim 1, wherein the two current limiting elements are formed by diodes.

* * * * *